US006376981B1

(12) United States Patent
Sluyterman et al.

(10) Patent No.: US 6,376,981 B1
(45) Date of Patent: Apr. 23, 2002

(54) COLOR DISPLAY DEVICE HAVING QUADRUPOLE CONVERGENCE COILS

(75) Inventors: Albertus A. S. Sluyterman; Nicolaas G. Vink; Tjerk G. Spanjer; Leopold C. M. Beirens, all of Eindhoven (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/338,048

(22) Filed: Jun. 22, 1999

Related U.S. Application Data

(63) Continuation-in-part of application No. 09/218,550, filed on Dec. 22, 1998.

(30) Foreign Application Priority Data

Dec. 29, 1997 (EP) ..... 97204128

(51) Int. Cl.[7] ..... H01J 29/70

(52) U.S. Cl. ..... 313/440; 313/412; 313/421; 313/428; 335/213; 445/36

(58) Field of Search ..... 313/440, 412, 313/421, 428; 335/210, 213, 214; 348/829; 445/36, DIG. 1

(56) References Cited

U.S. PATENT DOCUMENTS

| | | | | |
|---|---|---|---|---|
| 3,806,757 A | | 4/1974 | Saruta | 315/13 |
| 4,961,021 A | * | 10/1990 | Oguro et al. | 313/412 |
| 5,027,042 A | | 6/1991 | Sluyterman et al. | 315/368 |
| 5,070,280 A | | 12/1991 | Okuyama et al. | 315/368.11 |
| 5,248,920 A | | 9/1993 | Gioia et al. | 315/368.26 |
| 5,512,802 A | | 4/1996 | Jamar | 315/368.25 |
| 5,565,732 A | * | 10/1996 | Sluyterman et al. | 313/440 |

FOREIGN PATENT DOCUMENTS

| | | | |
|---|---|---|---|
| EP | 0382299 A1 | 8/1960 | H01J/29/70 |
| EP | 0421523 A1 | 4/1991 | H01J/29/56 |
| EP | 0507383 A1 | 10/1992 | H01J/29/56 |
| WO | WO9708729 | 3/1997 | H01J/29/70 |
| WO | WO9802035 | 1/1998 | A01K/31/04 |

* cited by examiner

*Primary Examiner*—Vip Patel
*Assistant Examiner*—Kevin Quarterman

(57) ABSTRACT

The invention relates to a color display device comprising an in-line electron gun (5) for generating three electron beams (6,7,8), and a convergence unit (14) to dynamically influence the convergence of the electron beams, preferably to decrease a distance (p) between the electron beams. The convergence unit (14) comprises a ring-shaped element (21) having four coils (22) and a longitudinal axis (24). A cross-section of the ring-shaped element (21) with a plane perpendicular to the longitudinal axis (24) is a circle with the longitudinal axis as its center and the ring-shaped element (21) forming the circumference. Each coil extends over the circumference over an angle $\phi$ having a value between 50° and 75°.

10 Claims, 2 Drawing Sheets

COLOR DISPLAY DEVICE HAVING QUADRUPOLE CONVERGENCE COILS

CROSS REFERENCE TO RELATED APPLICATIONS

This is a continuation-in-part of application Ser. No. 09/218,550, filed Dec. 22, 1998, which is herein incorporated by reference.

BACKGROUND OF THE INVENTION

The invention relates to a color display device comprising an in-line electron gun for generating three electron beams, and a unit for deflecting the electron beams across the color selection electrode.

Such display devices are known.

A present aim is to make the outer surface of the display window flatter, so that the image represented by the color display device is perceived by the viewer as flat. However, an increase of the radius of curvature of the outer surface will lead to an increase of a number of problems. The radius of curvature of the inner surface of the display window and of the color selection electrode should increase, and, as the color selection electrode becomes flatter, the strength of the color selection electrode decreases and hence the sensitivity to doming and vibrations increases. An alternative solution to this problem would be to curve the inner surface of the display window more strongly than the outer surface. By virtue thereof, a color selection electrode having a relatively small radius of curvature can be used. As a result, doming and vibration problems are reduced, however other problems occur instead. The thickness of the display window is much smaller in the center than at the edges. As a result, the weight of the display window increases and the intensity of the image decreases substantially towards the edges.

EP 0,421,523 discloses a color cathode ray tube with an in-line gun, a pin cushion correcting yoke and an eyebrow effect electronoptical distortion correction device comprising two pairs of coils, each pair having a coil on each outer electron beam side of the neck in the plane of the beams. The coil pairs are spaced apart along the z-axis between the gun and the yoke and are driven by a sawtooth current having a bow-tie envelope synchronous with the raster scan to correct the dynamic, antisymmetrical eyebrow effect apparent as a purity defect on the raster.

The non-prepublished applications PCT/IB98/02035 and U.S. Ser. No. 09/218,550 (attorneys' docket PHN 16.716) describe a color display device comprising a color cathode ray tube including an in-line electron gun for generating three electron beams being located substantially within a plane extending in an X-direction of a rectangular X-Y coordinate system, a color selection electrode, deflecting means for deflecting the electron beams located at a deflection plane, and first and second influencing means to dynamically influence the convergence of the electron beams, to decrease a distance between the electron beams at a location of the deflection plane.

SUMMARY OF THE INVENTION

It is an object of the invention to provide an improved color display device. To this end, the invention provides a color display device as defined in the independent claims and a method of manufacturing a convergence unit. The dependent claims describe advantageous embodiments.

These and other objects of the invention will be apparent from and elucidated with reference to the embodiments described hereinafter.

DESCRIPTION OF THE PREFERRED EMBODIMENT

Figure 1:
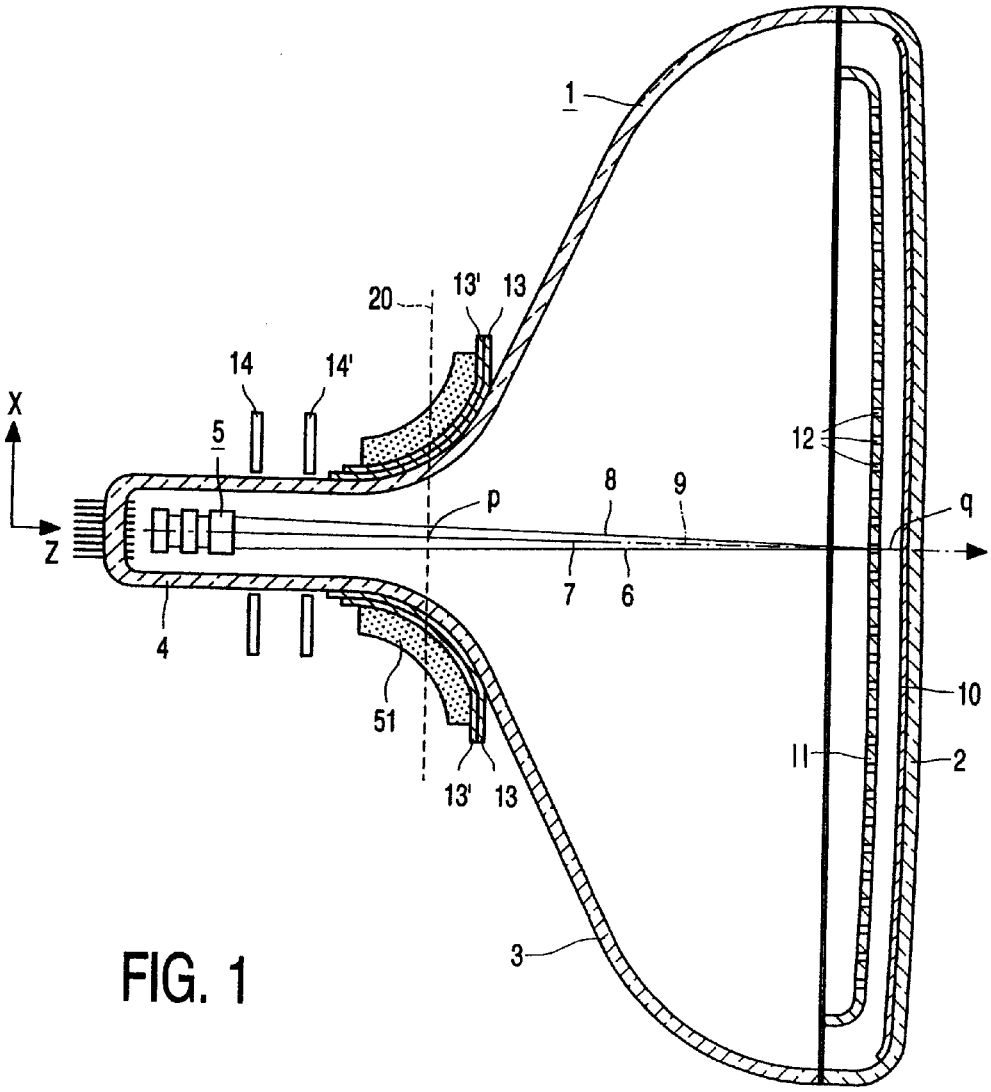
FIG. 1 is a sectional view of a display device, in which the invention is schematically shown.

The figures are not drawn to scale. In the figures, like reference numerals generally refer to like parts.

The display device shown in FIG. 1 comprises a cathode ray tube, in this example a color display tube, having an evacuated envelope 1 which includes a display window 2, a cone portion 3 and a neck 4. In the neck 4 there is arranged an in-line electron gun 5 for generating three electron beams 6, 7 and 8 which extend in one plane, the in-line plane, which is in this case the plane of the drawing. In the undeflected state, the central electron beam 7 substantially coincides with the tube axis q.

The inner surface of the display window is provided with a display screen 10. The display screen 10 comprises a large number of phosphor elements luminescing in red, green and blue. On their way to the display screen, the electron beams are deflected across the display screen by way of an electromagnetic deflection unit 51 and pass through a color selection electrode 11 which is arranged in front of the display window 2 and which comprises a thin plate having apertures 12. The three electron beams 6, 7 and 8 pass through the apertures 12 of the color selection electrode at a small angle relative to each other and hence each electron beam impinges only on phosphor elements of one color. The deflection unit 51 comprises, in addition to a coil holder 13, deflection coils 13' for deflecting the electron beams in two mutually perpendicular directions. The display device further includes means for generating voltages, which during operation are fed to components of the electron gun via feedthroughs. The deflection plane 20 is schematically indicated as well as the distance p between the electron beams 6 and 8 in this plane.

The color display device comprises two electron beam convergence influencing units 14, 14', whereby a first unit 14 is used, in operation, to dynamically bend, i.e. as a function of the deflection in a direction, the outermost electron beams towards each other, and a second unit 14' serves to dynamically bend the outermost electron beams in opposite directions.

The two units 14, 14' are positioned at some distance from each other, and are used to vary the distance p, as a function of the deflection, in a such a manner that the distance p decreases as a function of the deflection in at least one direction. The first unit 14 is positioned close to the gun and will be referred to as the "gun quadrupole", whereas the second unit 14' is located near the deflection unit and will be referred to as the "yoke quadrupole".

Figure 2:
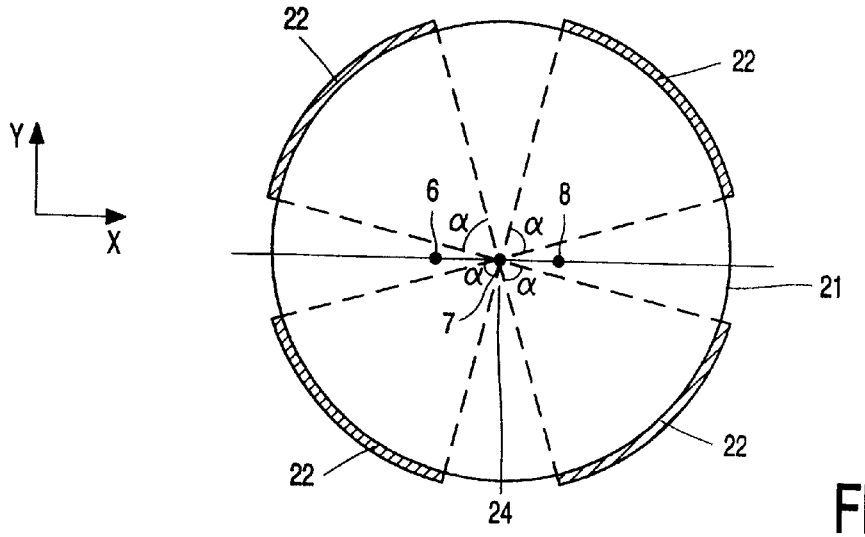
FIG. 2 shows a schematic cross-section of the first convergence unit according to the invention.

FIG. 2 shows a schematic cross-section of the first convergence unit 14 "gun quadrupole" according to an embodiment of the invention. The first convergence unit 14 comprises a ring-shaped element 21 having four coils 22 and a longitudinal axis 24. A cross-section of the ring-shaped element 21 with a plane perpendicular to the longitudinal axis results in a circle with the longitudinal axis 24 as its center and the ring-shaped element 21 forming the circumference. The in-line electron gun 5 for generating three electron beams 6, 7 and 8 is located substantially within a plane extending in an X-direction of a rectangular X-Y coordinate system. Each coil 22 extends over an angle α over the circumference, the angle α having a value between 50° and 75°. This embodiment of the convergence units has the advantage that magnetic quadrupole fields are generated, while undesired other order magnetic multiple fields are eliminated as good as possible.

Figure 3A:
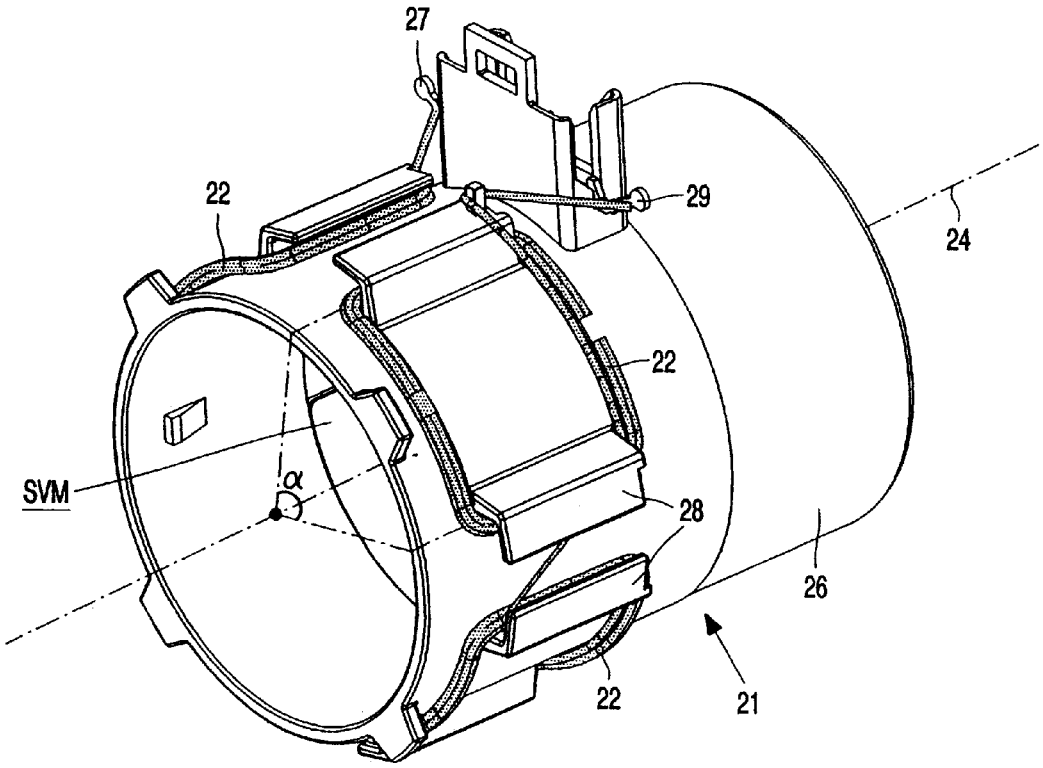
FIGS. 3A, 3B show an embodiment of the first convergence unit according to the invention.
Figure 3B:
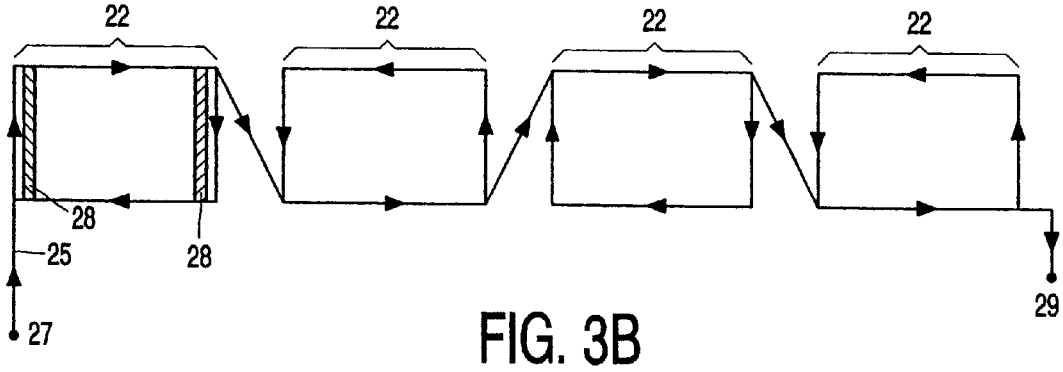

FIGS. 3A, 3B show an embodiment of the first convergence unit 14 ("gun quadrupole"), which comprises a cylindrically shaped element 21 having an outer surface 26 that is provided with protrusions 28 around which four coils 22 are wound in respective stacks of wire. Pins 27 and 29 are a starting position, respectively an end position of the coil winding process and are also used as connection pins to the outside electronics. The thus obtained gun quadrupole 14 comprises four identical coils 22, where each coil 22 is located in a quadrant of the circle and symmetrically arranged with respect to a line that has an angle of 45° with the X-direction. This embodiment has the advantage that a quadrupole element is created that—during operation—is almost free of dipole, 6-pole or 8-pole magnetic field components.

Further, the angle a has been chosen such that each coil 22 extends over an angle alpha having a value of 60°±5°. Here the angle α is measured from the middle of the stack of wires. This measure ensures the absence of 12-pole field components.

The cylindrical shape of the element 21 facilitates an easy positioning of the quadrupole in the neighborhood of the electron gun. A further advantage is that the cylinder may be used to contain additional coil elements SVM such as, for example a so-called Scan Velocity Modulator coil. This additional coil may be contained in the cylinder in the form of a wound-up foil.

In FIG. 3B the winding process is schematically indicated. Electrically conductive wire 25 is wrapped around pin 27 and —in this particular embodiment—63 full turns in the clockwise direction around a first set of protrusions 28 are made. Next, the second coil 22 is made by 63 full turns in the anti-clockwise direction, etc. After having completed all four coils 22 in this way the wire is wrapped around pin 29.

In summary, a preferred embodiment of the invention relates to a color display device comprising an in-line electron gun 5 for generating three electron beams 6,7,8, and convergence unit 14 to dynamically influence the convergence of the electron beams, to decrease a distance p between the electron beams. The convergence unit 14 comprises a ring-shaped element 21 having four coils 22 and a longitudinal axis 24. A cross-section of the ring-shaped element 21 with a plane perpendicular to the longitudinal axis 24 is a circle with the longitudinal axis as its center and the ring-shaped element 21 forming the circumference. Each coil extends over the circumference over an angle α having a value between 50° and 75°.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of other elements or steps than those listed in a claim. The word "a" or "an" preceding an element does not exclude the presence of a plurality of such elements.

What is claimed is:

1. A color display device comprising an in-line electron gun for generating three electron beams being located substantially within a plane extending in an X-direction of a rectangular X-Y coordinate system, deflecting means for deflecting the electron beams, and convergence means for dynamically influencing a convergence of the electron beams, the convergence means comprising a ring-shaped element having four coils and a longitudinal axis , a cross-section of the ring-shaped element with a plane perpendicular to the longitudinal axis being a circle with the longitudinal axis as its center and the ring-shaped element forming a circumference of the circle, each coil being disposed at the circumference and extending over an angle α over the circumference, the angle α having a value between 50° and 75°.

2. A color display device according to claim 1, wherein the deflecting means deflect the electron beams at a deflection region, and the convergence means dynamically influence the convergence of the electron beams, to decrease a distance (p) between the electron beams at the location of the deflection region.

3. A color display device according to claim 1, wherein each coil of the convergence means extends over an angle α having a value of 60°±5°.

4. A color display device according to claim 1, wherein each coil of the convergence means is located in a quadrant of the circle and symmetrically arranged with respect to a line that has an angle of 45° with the X-direction.

5. A color display device according to claim 1, wherein the convergence means comprises a cylindrically shaped element having an outer surface that is provided with protrusions around which the coils have been wound.

6. A method of manufacturing a convergence unit for dynamically influencing a convergence of electron beams in a color display device, the method comprising the steps of:

providing a ring-shaped element having a longitudinal axis , a cross-section of the ring-shaped element with a plane perpendicular to the longitudinal axis being a circle with the longitudinal axis as its center and the ring-shaped element forming a circumference of the circle, and applying four coils at the circumference of the ring-shaped element , each coil extending over an angle α over the circumference, the angle α having a value between 50° and 75°.

7. A color display apparatus comprising an envelope having a display window bearing a luminescent screen, said envelope containing an electron gun for producing a plurality of electron beams directed along an axis of the envelope and supporting a deflection device for producing a deflection field for deflecting the electron beams across the screen, said apparatus including a convergence device for dynamically influencing convergence of the electron beams, said convergence device comprising:

a. a ring-shaped element having a circumferential support surface surrounding the axis; and b. four coils disposed against said surface at different angular positions around the ring-shaped element, each of said coils extending over an angle $\alpha$ around the axis, said angle having a value between approximately 50° and 75°.

8. A color display apparatus as in claim 7 where, in operation, the deflection device deflects the electron beams at a deflection region and the convergence device decreases a distance (p) between said electron beams at said deflection region.

9. A color display apparatus as in claim 7 where the angle $\alpha$ has a value of approximately 50°±5°.

10. A color display apparatus as in claim 7 where the four coils are disposed symmetrically around the axis.

* * * * *